US005604085A

United States Patent [19]

Maskasky

[11] Patent Number: 5,604,085

[45] Date of Patent: Feb. 18, 1997

[54] HIGH BROMIDE ULTRATHIN EMULSIONS IMPROVED BY PEPTIZER SELECTION

[75] Inventor: Joe E. Maskasky, Rochester, N.Y.

[73] Assignee: Eastman Kodak Company, Rochester, N.Y.

[21] Appl. No.: 574,833

[22] Filed: Dec. 19, 1995

Related U.S. Application Data

[60] Provisional application No. 60/001,580 Jul. 27, 1995.

[51] Int. Cl. [6] ..... G03C 1/035; G03C 1/06

[52] U.S. Cl. ..... 430/567; 430/639; 430/641

[58] Field of Search ..... 430/567, 639, 430/641

[56] References Cited

U.S. PATENT DOCUMENTS

| | | | |
|---|---|---|---|
| 4,439,520 | 3/1984 | Kofron et al. | 430/434 |
| 4,717,650 | 1/1988 | Ikeda et al. | 430/567 |
| 5,250,403 | 10/1993 | Antoniades et al. | 430/505 |
| 5,284,744 | 2/1994 | Maskasky | 430/569 |

OTHER PUBLICATIONS

Mees *The Theory of the Photographic Process,* Revised Ed., Macmillan, 1951, pp. 48–49.

James *The Theory of the Photographic Process,* 4th Ed., Macmillan, 1977, p. 51.

*Research Disclosure,* vol. 365, Sep. 1994, Item 36544, II.

*Research Disclosure,* vol. 176, Dec. 1978, Item 17643, IX.

Buhr et al *Research Disclosure,* vol. 253, Item 25330, May 1985.

*Primary Examiner*—Thorl Chea

*Attorney, Agent, or Firm*—Carl O. Thomas

[57] ABSTRACT

An improved spectrally sensitized ultrathin tabular grain emulsion is disclosed in which tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 μm, and (e) exhibiting an average thickness of less than 0.07 μm, show an enhanced capability for chemical sensitization by reason of employing a cationic starch as a peptizer.

A photographic element is disclosed comprised of a support, a first silver halide emulsion layer coated on the support and sensitized to produce a photographic record when exposed to specular light within the minus blue visible wavelength region of from 500 to 700 nm, a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of the improved spectrally sensitized ultrathin tabular grain emulsion of the invention.

15 Claims, No Drawings

HIGH BROMIDE ULTRATHIN EMULSIONS IMPROVED BY PEPTIZER SELECTION

CROSS REFERENCE TO RELATED APPLICATION

Reference is made to and priority claimed from U.S. provisional application Ser. No. 60/001,580, filed 27 Jul. 1995, entitled HIGH BROMIDE ULTRATHIN TABULAR GRAIN EMULSIONS IMPROVED BY PEPTIZER SELECTION.

FIELD OF THE INVENTION

The invention is directed to photographic emulsions. More specifically, the invention is directed to high bromide ultrathin tabular grain emulsions containing selected peptizers.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabularity" is defined as $ECD/t^2$, where ECD and t are both measured in micrometers (μm).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "ultrathin tabular grain emulsion" refers to a tabular grain emulsion in which the average thickness of the tabular grains is less than 0.07 μm.

The term "high bromide" or "high chloride" in referring to grains and emulsions indicates that bromide or chloride, respectively, are present in concentrations of greater than 50 mole percent, based on total silver.

In referring to grains and emulsions containing two or more halides, the halides are named in order of ascending concentrations.

The term "{111} tabular" is employed in referring to tabular grains and tabular grain emulsions in which the tabular grains have {111} major faces.

The term "gelatino-peptizer" is employed to designate gelatin and gelatin-derived peptizers.

The terms "selected cationic starch peptizer" and "selected peptizer" are employed to designate a water dispersible cationic starch.

The term "cationic" in referring to starch indicates that the starch molecule has a net positive charge at the pH of intended use.

The term "water dispersible" in referring to cationic starches indicates that, after boiling the cationic starch in water for 30 minutes, the water contains, dispersed to at least a colloidal level, at least 1.0 percent by weight of the total cationic starch.

The term "middle chalcogen" designates sulfur, selenium and/or tellurium.

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

Gelatin and gelatin derivatives form both the peptizer and the major portion of the remainder of the vehicle in the overwhelming majority of silver halide photographic elements. An appreciation of gelatin is provided by this description contained in Mees *The Theory of the Photographic Process*, Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but nonjelling constituents of glue are not present in gelatin. Glue is thus distinguished by its adhesive properties; gelatin by its cohesive properties, which favor the formation of strong jellies.
>
> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.

Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 365, Sept. 1994, Item 36544, II. Vehicles, vehicle extenders, vehicle-like addenda and vehicle related addenda, A. Gelatin and hydrophilic colloid peptizers, paragraph (1) states:

> (1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar—agar, arrowroot, albumin and the like. . . .

This description is identical to that contained in *Research Disclosure,* Vol. 176, December 1978, Item 17643, IX. Vehicles and vehicle extenders, paragraph A. *Research Disclosure* is published by Kenneth Mason Publications, Ltd., Dudley House, 12 North St., Emsworth, Hampshire P010 7DQ, England.

During the 1980's a marked advance took place in silver halide photography based on the discovery that a wide range of photographic advantages, such as improved speed-granularity relationships, increased covering power, both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected high (>50 mole %) bromide tabular grain populations in photographic emulsions.

In descriptions of these emulsions, as illustrated by Kofron et al U.S. Pat. No. 4,439,520, the vehicle disclosure of *Research Disclosure* Item 17643 was incorporated verbatim. Only gelatin peptizers were actually demonstrated in the Examples.

Recently, Antoniades et al U.S. Pat. No. 5,250,403 disclosed tabular grain emulsions that represent what were, prior to the present invention, in many ways the best available emulsions for recording exposures in color photographic elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm and a mean thickness of less than 0.07 μm—i.e., ultrathin. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure,* Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements.

Whereas Kofron et al suggested that any conventional peptizer could be present during the preparation of tabular grain emulsions, even though actual precipitations demonstrated only gelatino-peptizers, Antoniades et al quite conspicuously requires the peptizers employed through grain nucleation to be selected from among gelatino-peptizers only. It is only after tabular grain nuclei have been formed that using other conventional peptizers is viewed as a possible alternative. However, Antoniades et al, like Kofron et al, demonstrates only gelatino-peptizers to be effective in preparing tabular grain emulsions.

Maskasky U.S. Pat. No. 5,284,744 taught the use of potato starch as a peptizer for the preparation of cubic (i.e., {100}) grain silver halide emulsions, noting that potato starch has a lower absorption, compared to gelatin, in the wavelength region of from 200 to 400 nm. Maskasky '744 does not disclose tabular grain emulsions.

RELATED APPLICATIONS

Maskasky U.S. Ser. No. 08/574,664, concurrently filed and commonly assigned, titled HIGH BROMIDE TABULAR GRAIN EMULSIONS IMPROVED BY PEPTIZER SELECTION, is directed to a high bromide tabular grain photographic emulsion containing as a peptizer a water dispersible cationic starch. This application has been abandoned in favor of Rule 62 continuation application 08/643,225, filed May 2, 1996.

Maskasky U.S. Ser. No. 08/574,834, filed Dec. 19, 1995, commonly assigned, titled PHOTOGRAPHIC EMULSIONS IMPROVED BY PEPTIZER MODIFICATION, is directed to radiation-sensitive silver halide emulsions containing an oxidized cationic starch as a peptizer.

Maskasky U.S. Ser. No. 08/574,489, filed Dec. 19, 1995, commonly assigned, titled HIGH BROMIDE ULTRATHIN TABULAR GRAIN EMULSIONS IMPROVED BY PEPTIZER MODIFICATION, is directed to an improved spectrally sensitized ultrathin tabular grain emulsion in which tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 mm, and (e) exhibiting an average thickness of less than 0.07 μm, show an enhanced capability for chemical sensitization by reason of employing an oxidized cationic starch as a peptizer.

SUMMARY OF THE INVENTION

In one aspect this invention is directed to a radiation-sensitive emulsion comprised of silver halide grains including tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 μm, and (e) exhibiting an average thickness of less than 0.07 μm, and a dispersing medium including a peptizer adsorbed to the silver halide grains, wherein the peptizer is a water dispersible cationic starch.

In another aspect this invention is directed to a photographic element comprised of (i) a support, (ii) a first silver halide emulsion layer coated on the support and sensitized to produce a photographic record when exposed to specular light within the minus blue visible wavelength region of from 500 to 700 nm, and (iii) a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to the invention.

It has been discovered quite surprisingly that cationic starches are better suited for preparing high bromide ultrathin {111} tabular grain emulsions than noncationic starches and that cationic starches, when present in place of gelatin, facilitate photographic advantages.

Cationic starches exhibit lower levels of viscosity than have previously been present in preparing ultrathin tabular grain emulsions. Reduced viscosity facilitates more uniform mixing. Both micromixing, which controls the uniformity of grain composition, mean grain size and dispersity, and bulk mixing, which controls scale up of precipitations to convenient manufacturing scales, are favorably influenced by the reduced viscosities made possible by cationic starch peptizers. Precise control over grain nucleation, including the monodispersity of the grain nuclei, is particularly important to successfully achieving and improving the properties of ultrathin tabular grain emulsions.

Under comparable levels of chemical sensitization higher photographic speeds can be realized with cationic starches. Alternatively, lower temperatures can be employed during chemical sensitization of cationic starch peptized ultrathin tabular grain emulsions to achieve photographic speeds equal or superior to those of gelatino-peptized ultrathin tabular grain emulsions. Lower temperatures have the advantage of protecting the ultrathin tabular grains from unwanted ripening, particularly thickening, during chemical sensitization.

DESCRIPTION OF PREFERRED EMBODIMENTS

The present invention is generally applicable to high bromide ultrathin {111} tabular grain emulsions. The emulsions are specifically contemplated for incorporation in camera speed color photographic films.

More specifically, the high bromide ultrathin {111} tabular grain emulsions of the invention are comprised of silver halide grains including tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 μm, and (e) exhibiting an average thickness of less than 0.07 μm.

The emulsions of the present invention can be readily distinguished from conventional high bromide ultrathin {111} tabular grain emulsions, such as those disclosed by Atoniades et al, in that a water dispersible cationic starch is adsorbed to the grain surfaces, thereby acting as a peptizer. Any conventional water dispersible cationic starch can be employed as a peptizer.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

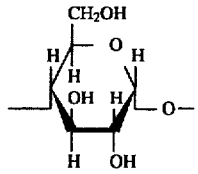

(I)

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

The water dispersible starches employed in the practice of the invention are cationic—that is, they contain an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

To be useful as a peptizer the cationic starch must be water dispersible. Many starches disperse in water upon heating to temperatures up to boiling for a short time (e.g., 5 to 30 minutes). High sheer mixing also facilitates starch dispersion. The presence of cationic substituents increases the polar character of the starch molecule and facilitates dispersion. The starch molecules preferably achieve at least a colloidal level of dispersion and ideally are dispersed at a molecular level—i.e., dissolved.

The following teachings, the disclosures of which are here incorporated by reference, illustrate water dispersible cationic starches within the contemplation of the invention:

Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
Barber et al U.S. Pat. No. 3,219,518;
Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
Dishburger et al U.S. Pat. No. 3,467,608;
Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
Tsai et al U.S. Pat. No. 5,227,481; and
Tsai et al U.S. Pat. No. 5,349,089.

The water dispersible cationic starch is present during the precipitation (during nucleation and grain growth or during grain growth) of the high bromide {111} tabular grains. Preferably precipitation is conducted by substituting the water dispersible cationic starch for all conventional gelatino-peptizers. In substituting the selected cationic starch peptizer for conventional gelatino-peptizers, the concentrations of the selected peptizer and the point or points of addition can correspond to those employed using gelatino-peptizers.

In addition, it has been unexpectedly discovered that emulsion precipitation can tolerate even higher concentrations of the selected peptizer. For example, it has been observed that all of the selected peptizer required for the preparation of an emulsion through the step of chemical sensitization can be present in the reaction vessel prior to grain nucleation. This has the advantage that no peptizer additions need be interjected after tabular grain precipitation has commenced. It is generally preferred that from 1 to 500 grams (most preferably from 5 to 100 grams) of the selected peptizer per mole of silver to be precipitated be present in the reaction vessel prior to tabular grain nucleation.

At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid tabular grain agglomeration.

The procedures for high bromide ultrathin {111} tabular grain emulsion preparation through the completion of tabular grain growth require only the substitution of the selected peptizer for conventional gelatino-peptizers. Although criteria (a) through (e) are too stringent to be satisfied by the vast majority of known tabular grain emulsions, a few published precipitation techniques are capable of producing emulsions satisfying these criteria. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

For camera speed films it is generally preferred that the tabular grains contain at least 0.25 (preferably at least 1.0) mole percent iodide, based on silver. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

As is generally well understood in the art, precipitation techniques, including those of Antoniades et al and Zola and Bryant, that produce silver iodobromide tabular grain emulsions can be modified to produce silver bromide tabular grain emulsions of equal or lesser mean grain thicknesses simply by omitting iodide addition. This is specifically taught by Kofron et al.

It is possible to include minor amounts of chloride ion in the ultrathin tabular grains. As CHLORIDE CONTAINING HIGH BROMIDE ULTRATHIN TABULAR U.S. Pat. No. 5,460,934, now allowed, both commonly assigned and here incorporated by reference, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

The high bromide ultrathin {111} tabular grain emulsions that are formed preferably contain at least 70 mole percent bromide and optimally at least 90 mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent. Significant photographic advantages can be realized with iodide concentrations as low as 0.5 mole percent, with an iodide concentration of at least 1 mole percent being preferred.

When the ultrathin tabular grains include iodide, the iodide can be uniformly distributed within the tabular grains. To obtain a further improvement in speed-granularity relationships it is preferred that the iodide distribution satisfy the teachings of Solberg et al U.S. Pat. No. 4,433,048, the disclosure of which is here incorporated by reference.

The high bromide ultrathin {111} tabular grain emulsions exhibit mean grain ECD's ranging from 0.7 to 10 μm. The minimum mean ECD of 0.7 μm is chosen to insure light transmission with minimum high angle light scattering. In other words, tabular grain emulsions with a mean ECD of at least 0.7 μm produce sharper images, particularly in coating formats in which another emulsion layer of any conventional type underlies the emulsion of the invention. Although the maximum mean ECD of the tabular grains can range up to 10 μm, in practice, the tabular grain emulsions of the invention typically exhibit a mean ECD of 5.0 μm or less. An optimum ECD range for moderate to high image structure quality is in the range of from 1 to 4 μm.

The ultrathin tabular grains typically have triangular or hexagonal major faces. The tabular structure of the grains is attributed to the inclusion of parallel twin planes.

The tabular grains of the emulsions of the invention account for greater than 70 percent and preferably greater than 90 percent of total grain projected area. Emulsions according to the invention can be prepared following the procedures of Antoniades et al or Delton, both cited above, in which "substantially all" (>97%) of the total grain projected area is accounted for by tabular grains.

Ultrathin (<0.07 μm) tabular grains are specifically preferred for minus blue recording in photographic elements forming dye images (i.e., color photographic elements). An important distinction between ultrathin tabular grains and those having greater (≧0.07 μm) thicknesses resides in the difference in their reflective properties. Ultrathin tabular grains exhibit little variation in reflection as a function of the wavelength of visible light to which they are exposed, where as thicker tabular grains exhibit pronounced reflection maxima and minima as a function of the wavelength of light. Hence ultrathin tabular grains simplify construction of photographic element intended to form plural color records (i.e., color photographic elements). This property, together with the more efficient utilization of silver attributable to ultrathin grains, provides a strong incentive for their use in color photographic elements.

As the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et al suggests a practical minimum tabular grain thickness about 0.01 μm.

Conventional dopants can be incorporated into the tabular grains during their precipitation, as illustrated by the patents cited above and *Research Disclosure,* Item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the tabular grains as disclosed in *Research Disclosure,* Vol. 367, November 1994, Item 36736.

It is also recognized that silver salts can be epitaxially grown onto the tabular grains during the precipitation process. Epitaxial deposition onto the edges and/or corners of tabular grains is specifically taught by Maskasky U.S. Pat. No. 4,435,501, here incorporated by reference. In a specifically preferred form high chloride silver halide epitaxy is present at the edges or, most preferably, restricted to corner adjacent sites on the tabular grains.

Although epitaxy onto the host tabular grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure,* Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

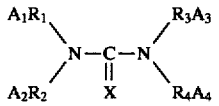

(II)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(III)}$$

wherein

L is a mesoionic compound;

X is an anion; and $L^1$ is a Lewis acid donor.

In another preferred form of the invention it is contemplated to employ alone or in combination with sulfur sensitizers, such as those formula I, and/or gold sensitizers, such as those of formula II, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

Preferred 2-[N-(2-alkynyl)amino]-meta-chalcoazoles can be represented by the formula:

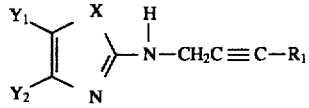

(IV)

where

X=O, S, Se;

$R_1$=(IVa) hydrogen or (IVb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula IV compounds are generally effective (with the IVb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the tabular grains exhibit significant native sensitivity. While spectral sensitization is most commonly undertaken after chemical sensitization, spectral sensitizing dye can be advantageous introduced earlier, up to and including prior to grain nucleation. Kofron et al discloses advantages for "dye in the finish" sensitizations, which are those that introduce the spectral sensitizing dye into the emulsion prior to the heating step (finish) that results in chemical sensitization. Maskasky U.S. Pat. No. 4,435,501 teaches the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogous that exhibit absorption maxima in the green and red portions of the spectrum, are particularly preferred for incorporation in the tabular grain emulsions of the invention. A more general summary of useful spectral sensitizing dyes is provided by *Research Disclosure,* Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

At any time following chemical sensitization and prior to coating additional vehicle is added to the emulsions of the invention. Conventional vehicles and related emulsion components are illustrated by *Research Disclosure,* Item 36544, cited above, Section II. Vehicles, vehicle extenders, vehicle-like addenda and vehicle related addenda.

Aside from the features described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure,* Item 36544, Section I. Emulsion grains and their preparation, E. Blends, layers and performance categories. Other common, but optional features are illustrated by *Research Disclosure,* Item 36544, Section VII, Antifoggants and stabilizers; Section VIII, Absorbing and scattering materials; Section IX, Coating physical property modifying agents; Section X, Dye image formers and modifiers. The features of Sections II and VII–X can alternatively be provided in other photographic element layers.

The photographic applications of the emulsions of the invention can encompass other conventional features, such as those illustrated by *Research Disclosure,* Item 36544, Sections:

| | |
|---|---|
| XI. | Layers and layer arrangements |
| XII. | Features applicable only to color negative |
| XIII. | Features applicable only to color positive |
| XIV. | Scan facilitating features |
| XV. | Supports |
| XVI. | Exposure |
| XVII. | Physical development systems |
| XVIII. | Chemical development systems |
| XIX. | Development |
| XX. | Desilvering, washing, rinsing and stabilizing (post-development) |

The high bromide ultrathin {111} tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. Exemplary photographic supports are summarized by *Research Disclosure,* Item 36544, cited above, Section XV, here incorporated by reference. The emulsion layer coated nearer the support surface is spectrally sensitized to produce a photographic record when the photographic element is exposed to specular light within the minus blue portion of the visible spectrum. The term "minus blue" is employed in its art recognized sense to encompass the green and red portions of the visible spectrum—i.e., from 500 to 700 nm. The term "specular light" is employed in its art recognized usage to indicate the type of spatially oriented light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. The second emulsion layer in most applications records blue or minus blue light and usually, but not necessarily, records light of a shorter wavelength than the first emulsion layer. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been observed that a favorable combination of photographic sensitivity and image structure (e.g., granularity and sharpness) are realized when high bromide ultrathin {111} tabular grain emulsions satisfying the requirements of the invention are employed to form at least the second, overlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain projected area, since these grains are relatively optically transparent. Excluding grains having an ECD of less than 0.2 μm in calculating total grain projected area, it is contemplated that the overlying emulsion layer containing the ultrathin tabular grain emulsion of the invention account for greater than 70 percent, preferably greater than 90 percent, and optimally "substantially all" (i.e., >97%), of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 90% and optimally greater than 97% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains preferably contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of ultrathin tabular grains that are peptized by cationic starch and sensitized in the absence of a gelatino-peptizer allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to the following specific examples. Except as otherwise indicated all weight percentages (wt %) are based on total weight.

Examples 1 through 7

These examples demonstrate the precipitation of ultrathin tabular grain emulsions using a cationic starch derived from different plant sources, including a variety of potato and grain sources. The starches were selected to demonstrate a wide range of nitrogen and phosphorus contents. Variations in emulsion precipitation conditions are also demonstrated. Particularly significant is the demonstration that all of the cationic starch used for the entire precipitation can be added prior to grain nucleation.

Example 1

AgIBr (3 mole % I) Ultrathin Tabular Grain Emulsion Made Using a Cationic Potato Starch A starch solution was prepared by boiling for 30 min a stirred mixture of 80 g cationic potato starch (STA-LOK ® 400, obtained from A. E. Staley Manufacturing Co., Decatur, Ill.), 27 mmoles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2 M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by ultrafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

Example 2

AgIBr (3 mole % I) Ultrathin Tabular Grain Emulsion Made Using a Cationic Corn Starch A starch solution was prepared by boiling for 30 min a stirred 400 g aqueous mixture containing 2.7 mmoles of NaBr and 8.0 g of a cationic hybrid corn starch (CATO ® 235, obtained from National Starch and Chemical Company, Bridgewater, N.J.) containing 0.31 wt % nitrogen and 0.00 wt % phosphorous.

The resulting solution was cooled to 35° C., readjusted to 400 g with distilled water. To a vigorously stirred reaction vessel of the starch solution at 35° C, pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

Example 3

AgIBr (3 mole % I) Ultrathin Tabular Grain Emulsion Made Using a Cationic Amphoteric Potato Starch This emulsion was prepared similarly to Example 2, except that the starch used was a cationic amphoteric potato starch (Wespol A ®, obtained from Western Polymer Corporation, Moses Lake, Wash.) containing both a quaternary trimethyl ammonium alkyl starch ether (0.36 wt % nitrogen) and orthophosphate (0.70 wt % phosphorous) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

Example 4

AgIBr (3 mole % I) Ultrathin Tabular Grain Emulsion Made Using a Cationic Amphoteric Potato Starch This emulsion was prepared similarly to Example 3, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

Example 5

AgIBr (3 mole % I) Ultrathin Tabular Grain Emulsion Made Using a Cationic Potato Starch and at pH 2.0.

This emulsion was prepared similarly to Example 2, except that the emulsion was precipitated at pH 2.0 and the starch used was cationic potato starch (STA-LOK ® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

Example 6

AgIBr (3 mole % I) Ultrathin Tabular Grain Emulsion Made Using a Cationic Corn Starch This emulsion was prepared similarly to Example 2, except that the emulsion was precipitated at pH 6.0, and the starch used was a cationic waxy corn starch (STA-LOK ® 180, obtained from A. E. Staley Manufacturing Co.) made up of 100% amylopectin derivatized to contain 0.36 wt % nitrogen in the form of a quaternary trimethyl ammonium alkyl starch ether and 0.06 wt % phosphorous, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

Example 7

AgBr Ultrathin Tabular Grain Emulsion Made by Adding 94% of a Cationic Potato Starch After Grain Nucleation A starch solution was prepared by boiling for 30 min a stirred 200 g aqueous mixture containing 3.75 mmoles of NaBr and 8.0 g of the cationic potato starch STA-LOK ® 400.

To a vigorously stirred reaction vessel of 12.5 g of the starch solution (0.5 g starch), 387.5 g distilled water, and 2.2 mmole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

Control Examples 8 through 12

These examples demonstrate tabular grain preparation failures resulting from choosing noncationic starches as peptizers.

Control Example 8

AgIBr (3 mole % I) Nontabular Grain Emulsion Made Using a Water-Soluble Carboxylated (Noncationic) Corn Starch This emulsion was prepared similarly to Example 2, except that the starch used was a corn starch (FILMKOTE ® 54, obtained from National Starch and Chemical Co.), which, as purchased, was derivatized to contain carboxylate groups. The nitrogen content was natural, 0.06 wt %.

A nontabular grain emulsion resulted.

Control Example 9

AgIBr (3 mole % I) Nontabular Grain Emulsion Made Using a Water-Soluble Orthophosphate Derivatized (Noncationic) Potato Starch This emulsion was prepared similarly to Example 2, except that the starch used was an orthophosphate derivatized potato starch 0.03 wt % nitrogen (natural), and orthophosphate substituents, 0.66 wt % phosphorous. The sample was obtained from Western Polymer Corporation.

A nontabular grain emulsion resulted.

Control Example 10

AgIBr (3 mole % I) Nontabular Grain Emulsion Made Using a Water-Soluble Hydroxypropyl-substituted (Noncationic) Corn Starch This emulsion was prepared similarly to Example 2, except that the starch (STARPOL ® 530, was obtained from A. E. Staley Manufacturing Co.) used was a hydroxypropyl-substituted corn starch, 0.06 wt % nitrogen (natural) and 0.12 wt % phosphorous.

A nontabular grain emulsion resulted.

Control Example 11

AgIBr (3 mole % I) Nontabular Grain Emulsion Made Using a Water-Soluble (Noncationic) Potato Starch This emulsion was prepared similarly to Example 2, except that the starch (Soluble Potato Starch obtained from Sigma Chemical Company, St. Louis, Mo.) used was a treated and purified water soluble potato starch, 0.04 wt % nitrogen and 0.06 wt % phosphorous.

A nontabular grain emulsion resulted.

Control Example 12

AgIBr (3 mole % I) Nontabular Grain Emulsion Made Using a Water-Soluble (Noncationic) Wheat Starch This emulsion was prepared similarly to Example 2, except that the starch (Supergel ® 1400, obtained from ADM/Ogilvie, Montreal, Quebec, Canada) used was a water soluble noncationic wheat starch.

A nontabular grain emulsion resulted.

Control Example 13

AgIBr (3 mole % I) Nontabular Grain Emulsion Made Using the Grain Protein Zein

This example demonstrates the failure of zein, a grain protein, to act as a peptizer.

In a stirred reaction vessel, 8.0 g of zein (obtained from Sigma Chemical Co.) in 400 g distilled water containing 2.7 mole of NaBr was boiled for 60 min. Most of the zein did not appear to dissolve. The mixture was filtered and the filtrate was used as the starch solution to precipitate silver halide using conditions similar to those used in Example 2.

The resulting precipitation resulted in large clumps of nontabular grains.

Control Examples 14 through 17

These examples demonstrate tabular grain preparation failures resulting from choosing noncationic starch-like substances as peptizers.

Control Example 14

AgIBr (3 mole % I) Nontabular Grain Emulsion Made Using the Noncationic Polysaccharide Dextran This emulsion was prepared similarly to Example 2, except that the polysaccharide dextran (obtained from Sigma Chemical Co., St. Louis, Mo.), having a molecular weight of approximately 500,000, was employed.

The resulting precipitation resulted in large clumps of nontabular grains. Dextran was unable to peptize the silver halide grains.

Control Example 15

AgIBr (3 mole % I) Nontabular Grain Emulsion Made Using the Noncationic Polysaccharide, Agar This emulsion was prepared similarly to Example 2 except that the polysaccharide used was agar (purified, ash content <2%), obtained from Sigma Chemical Co.

The resulting precipitation resulted in large clumps and isolated nontabular grains. Agar was a poor peptizer for silver halide grains.

Control Example 16

AgIBr (3 mole % I) Nontabular Grain Emulsion Made Using the Noncationic Polysaccharide Pectin This emulsion was prepared similarly to Example 2, except that the polysaccharide used was pectin from citrus fruit (obtained from Sigma Chemical Co).

A nontabular grain emulsion resulted.

Control Example 17

AgIBr (3 mole % I) Nontabular Grain Emulsion Made Using the Noncationic Polysaccharide, Gum Arabic This emulsion was prepared similarly to Example 2, except that the polysaccharide used was gum arabic (obtained from Sigma Chemical Co.), having a molecular weight of about 250,000.

A nontabular grain emulsion resulted.

Control Examples 18 through 20

These examples confirm that the experimental conditions demonstrated above to produce tabular grain emulsions with cationic starch worked poorly using gelatin. While gelatin is a well known peptizer for the precipitation of tabular grain emulsions, the choice of adding all of the peptizer before grain nucleation, demonstrated above using cationic starches, hampered tabular grain emulsion preparation.

Control Example 18

AgIBr (3 mole % I) Tabular Grain Emulsion Made Using Gelatin as Peptizer.

This emulsion was prepared similarly to Example 2, except that oxidized bone gelatin was substituted for the starch.

The tabular grain population of the resulting emulsion was comprised of tabular grains with an average equivalent circular diameter of 2.2 μm, an average thickness of 0.07

μm, and an average aspect ratio of 31. The tabular grain population made up 60% of the total projected area of the emulsion grains, down from 85% in Example 2.

Control Example 19

AgIBr (3 mole % I) AgIBr Nontabular Grain Emulsion Made Using Gelatin as Peptizer.

This emulsion was prepared similarly to Control Example 28, except that precipitation was terminated after the addition of 0.1 mole of silver nitrate.

The tabular grain population of the resulting emulsion was comprised of tabular grains with an average equivalent circular diameter of 2.0 μm, an average thickness of 0.06 μm, and an average aspect ratio of 33. The tabular grain population made up only 30% of the total projected area of the emulsion grains.

Control Example 20

AgBr Nontabular Grain Emulsion Made Using Gelatin as Peptizer.

This emulsion was prepared similarly to Example 2, except that oxidized bone gelatin was substituted for the starch, the salt solution used was 2.0M NaBr, and, after the accelerated addition of $AgNO_3$, the flow of $AgNO_3$ was maintained at 5 mL/min until a total of 200 mL was added.

The tabular grain population of the resulting emulsion was comprised of tabular grains with an average equivalent circular diameter of 3.2 μm, an average thickness of 0.07 μm, and an average aspect ratio of 46. The tabular grain population made up only 30% of the total projected area of the emulsion grains.

Control Example 21

AgIBr (2.7 mole % I) Tabular Grain Emulsion

This emulsion was prepared in bone gelatin using conventional techniques favorable for the formation of tabular grain emulsions for the purpose of providing an emulsion with tabular grain thicknesses equal to or less than and tabular grain projected areas equal to or greater than those of the tabular grain emulsion precipitated in cationic starch reported in Example 1.

The emulsion was diafiltered-washed to a pBr of 3.38 at 40° C. The tabular grains had an average equivalent circular diameter of 2.45 μm, an average thickness of 0.06 μm, and an average aspect ratio of 41. The tabular grain population made up 95% of the total projected area of the emulsion grains.

TABLE I

Emulsion Summary

| Example (Control) | Peptizer | Cationic | Wt % Nitrogen | Wt % Phosphorus | Tabular Grain ECD/T (μm) | Tabular Grains as % of Total Grain Projected Area |
|---|---|---|---|---|---|---|
| 1 | Potato Starch | Yes | 0.33 | 0.13[a] | 1.2/0.06 | 92 |
| 2 | Hybrd Corn S. | Yes | 0.31 | 0.00 | 1.6/0.06 | 85 |
| 3 | Potato Starch | Yes | 0.36 | 0.70 | 1.7/0.05 | 95 |
| 4 | Potato Starch | Yes | 0.36 | 0.70 | 1.0/0.045 | 95 |
| 5 | Potato Starch | Yes | 0.33 | 0.13[a] | 1.5/0.06 | 80 |
| 6 | Waxy Corn S. | Yes | 0.36 | 0.06[a] | 1.6/0.06 | 91 |
| 7 | Potato Starch | Yes | 0.33 | 0.13[a] | 1.0/0.055 | 90 |
| (8) | Corn Starch | No | 0.06[a] | 0.00 | NT | 0 |
| (9) | Potato Starch | No | 0.03[a] | 0.66 | NT | 0 |
| (10) | Corn Starch | No | 0.06[a] | 0.00 | NT | 0 |
| (11) | Potato Starch | No | 0.04[a] | 0.06 | NT | 0 |
| (12) | Wheat Starch | No | NM | NM | NT | 0 |
| (13) | Zein | No | NM | NM | NT | 0 |
| (14) | Dextran | No | NM | NM | NT | 0 |
| (15) | Agar | No | NM | NM | NT | 0 |
| (16) | Pectin | No | NM | NM | NT | 0 |
| (17) | Gum Arabic | No | NM | NM | NT | 0 |
| (18) | Gelatin | NA | NA | NA | 2.2/0.07 | 60 |
| (19) | Gelatin | NA | NA | NA | 2.0/0.06 | 30 |
| (20) | Gelatin | NA | NA | NA | 3.2/0.07 | 30 |
| (21) | Gelatin | NA | NA | NA | 2.45/0.06 | 95 |

[a]Natural content
[b]Calculated from the degree of substitution.
NT = Nontabular
NM = Not Measured
NA = Not Applicable Example 22

Photographic Comparisons

Four emulsion samples were compared.

The tabular grain emulsion of Example 1, precipitated in the presence of cationic starch, was divided into three portions to form three samples. Two portions received no further treatment until sensitization, "Example 1 STA" and "Example 1 STA-Spectral". The samples were identical, but the latter sample received only spectral sensitization, instead of chemical and spectral sensitization, as in the case of the remaining emulsion samples.

To 0.81 mole of the third portion, "Example 1 GEL", 20 g of bone gelatin in 100 mL distilled water were added. The purpose of adding gelatin was to demonstrate the effect of gelatin added as a vehicle after precipitation and before chemical sensitization, as is conventional practice.

A fourth emulsion sample was taken from a conventional silver iodobromide (2.7 mole % I) tabular grain precipitated in bone gelatin, Control Example 21. The purpose of providing this sample was to compare the properties of an emulsion precipitated in gelatin to the emulsions precipitated in the absence of gelatin and sensitized either in the presence or absence of gelatin.

To 0.035 mole of the emulsion sample (see Table II, below) at 40° C., with stirring, were added sequentially the following solutions containing (mole/mole Ag); 2.5 of NaSCN, 0.22 of a benzothiazolium salt, 1.5 of anhydro-5, 5-'dichloro-3,3'bis(3-sulfopropyl)thiacyanine hydroxide, triethylammonium salt, and 0.08 of 1-(3-acetamidophenyl)-5-mercaptotetrazole, sodium salt. The pH was adjusted to 5.9. Then the following solutions were sequentially added (mmole/mole Ag) 0.023 of 2-propargylaminobenzoxazole, 0.036 of 1,3-dicarboxymethyl-1,3-dimethyl-2-thiourea, and 0.014 of bis(1,3,5-trimethyl-1,2,4-triazolium-3-thiolate) gold (I) tetrafluoroborate. The mixture was heated to 55° C. at a rate of 5° C./3 min, and held at 55° C. for 15 min. Upon cooling to 40° C., a solution of 1.68 of 5-bromo-4-hydroxy-6-methyl-1,3,3a,7-tetraazaindene was added. Example 1 STA-Spectral only had the spectral sensitizing dye added.

The resulting sensitized emulsions were mixed with gelatin, yellow dye-forming coupler dispersion, surfactants, and hardener and coated onto clear support at 0.84 g/m$^2$ silver, 1.7 g/m$^2$ yellow dye-forming coupler, and 3.5 g./m$^2$ bone gelatin.

The coatings were exposed to blue light for 0.02 sec through a 0 to 4.0 log density graduated step tablet, processed in the Kodak Flexicolor C-41 ™ color negative process using a development time of 3 min 15 sec.

The results are summarized in Table II.

TABLE II

| Emulsion Sensitized | $D_{max}$ | $D_{min}$ | Mid-Scale Contrast | Relative Speed at 0.2 above Dmin |
|---|---|---|---|---|
| Control Example 21 | 3.03 | 0.08 | 2.01 | 100 |
| Example 1 GEL | 2.86 | 0.09 | 1.79 | 115 |
| Example 1 STA | 3.18 | 0.13 | 2.08 | 204 |
| Example 1 STA-Spectral | 0.70 | 0.05 | 1.69 | −11 |

Control Example 21, a conventional tabular grain emulsion in which the grains were precipitated in gelatin, was employed as the speed reference. Example 1 GEL, which was precipitated in cationic starch, but had gelatin added before chemical sensitization, exhibited a speed that was 15 relative speed units faster than the speed of Control Example 21. Thus, Example 1 GEL was 0.15 log E (15 relative speed units=0.15 log E, where E is exposure in lux-seconds) faster than Control Example 21. This amounted to a speed advantage of (one-half stop). It was unexpected that precipitation in cationic starch as opposed to gelatin would produce this significant speed advantage.

Quite surprising was the large speed advantage demonstrated by Example STA. This emulsion, which precipitated and sensitized in the absence of gelatin, was 1.04 log E faster than Control Example 31. In other words, it was more than 10 times faster than the conventional Control Example 21 emulsion.

Example 1 STA-Spectral was included to demonstrate that the cationic starch itself, apart from the chemical sensitizers, was not imparting the speed observed. Example 1 STA-Spectral was 11 relative speed units (1.11 log E) slower than Control Example 31. From this it was concluded that the cationic starch was in some way permitting better interaction of the chemical sensitizer with the grain surface than is conventionally realized by employing gelatin as a peptizer.

Example 23

Testing for Starch Retained after Washing

A coating of Example 1 STA prepared as described in Example 22 was treated with a 0.2 wt % solution of active proteolytic enzyme (H.T.-Proteolytic 200 from Miles Labs, Inc., Elkhart, Ind.) for 30 min at 35° C. to degrade the gelatin. The emulsion grains were washed twice in distilled water and examined by infrared spectroscopy. The infra-red absorption spectrum of the starch was clearly observed, demonstrating that the starch remained a permanent part of the emulsion and was not removed by washing.

Example 24

Peptizer Viscosity Comparisons

CS

A 2 percent by weight cationic starch solution, CS, was prepared by boiling for 30 min a stirred mixture of 8 g STA-LOK ® 400, 2.7 mmoles of NaBr and distilled water to 400 mL. The solution was sonicated for 3 min. The resulting solution was cooled to 40° C., readjusted to 400 mL with distilled water, sonicated for 3 min, and the pH adjusted to 6.0.

GEL

A 2 percent by weight gealtin solution, GEL was prepared using bone gelatin. To 4 L was added 27 mmoles of NaBr and the pH was adjusted to 6.0 at 40° C.

The kinematic viscosities of water and the CS and GEL solutions were measured at various temperatures. The results are given below.

TABLE III

| | Viscosity (cP) | | |
|---|---|---|---|
| | Temperature | | |
| Solution | 40° C. | 20° C. | 11° C. |
| Water | 0.66 | 1.00 | 1.27 |
| CS | 3.55 | 5.71 | 7.39 |
| GEL | 1.67 | X | X |

X = Could not be run because the solution solidified.

The viscosity data show that cationic starch has low viscosity at low temperatures while the gelatin solution solidified. This makes cationic starch particularly useful for silver halide grain nucleation and/or growth at temperatures below 25° C. The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains including tabular grains (a) having {111} major faces, (b) containing greater than 50 mole percent bromide, based on silver, (c) accounting for greater than 70 percent of total grain projected area, (d) exhibiting an average equivalent circular diameter of at least 0.7 μm, and (e) exhibiting an average thickness of less than 0.07 μm, and a dispersing medium including a peptizer adsorbed to the silver halide grains, wherein the peptizer is a water dispersible cationic starch.

2. A radiation-sensitive emulsion according to claim 1 wherein the cationic starch is comprised of α-amylose.

3. A radiation-sensitive emulsion according to claim 1 wherein the cationic starch is comprised of amylopectin.

4. A radiation-sensitive emulsion according to claim 1 wherein the starch contains cationic moieties selected from among protonated amine moieties and quaternary ammonium, sulfonium and phosphonium moieties.

5. A radiation-sensitive emulsion according to claim 1 wherein the cationic starch contains α-D-glucopyranose repeating units having 1 and 4 position linkages.

6. A radiation-sensitive emulsion according to claim 5 wherein the cationic starch additionally contains 6 position linkages in a portion of the α-D-glucopyranose repeating units to form a branched chain polymeric structure.

7. A radiation-sensitive emulsion according to claim 1 wherein the tabular grains account for at least 90 percent of total grain projected area.

8. A radiation-sensitive emulsion according to claim 1 wherein the peptizer consists essentially of the cationic starch.

9. A radiation-sensitive emulsion according to claim 1 wherein the cationic starch is dispersed to at least a colloidal level of dispersion.

10. A radiation-sensitive emulsion according to claim 9 wherein the cationic starch is at least in part present as an aqueous solute.

11. A radiation-sensitive emulsion according to claim 10 wherein the tabular grains are chemically sensitized.

12. A radiation-sensitive emulsion according to claim 11 wherein the tabular grains are chemically sensitized with at least one of sulfur, gold and reduction sensitizers.

13. A radiation-sensitive emulsion according to claim 11 wherein a photographic vehicle is combined with the chemically sensitized tabular grains.

14. A radiation-sensitive emulsion according to claim 13 wherein the photographic vehicle includes gelatin or a gelatin derivative.

15. A photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of at least a portion of the minus blue light intended for the exposure of the first silver halide emulsion layer in the form of specular light, wherein the second silver halide emulsion layer is comprised of an improved emulsion according to any one of claims 1 to 15 inclusive.

* * * * *